US008323790B2

(12) United States Patent
Chun et al.

(10) Patent No.: US 8,323,790 B2
(45) Date of Patent: Dec. 4, 2012

(54) BIMODAL AND MULTIMODAL DENSE BORIDE CERMETS WITH LOW MELTING POINT BINDER

(75) Inventors: ChangMin Chun, Belle Mead, NJ (US); Narasimha-Rao Venkata Bangaru, Pittstown, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1021 days.

(21) Appl. No.: 12/291,899

(22) Filed: Nov. 14, 2008

(65) Prior Publication Data

US 2009/0186211 A1 Jul. 23, 2009

Related U.S. Application Data

(60) Provisional application No. 61/003,800, filed on Nov. 20, 2007.

(51) Int. Cl.
*B32B 18/00* (2006.01)
*C04B 35/00* (2006.01)
*C22C 32/00* (2006.01)

(52) U.S. Cl. ..... 428/325; 419/12; 419/54; 501/96.3

(58) Field of Classification Search ..... None
See application file for complete search history.

(56) References Cited

U.S. PATENT DOCUMENTS

| | | | |
|---|---|---|---|
| 1,968,067 | A | 7/1934 | Balke |
| 3,194,656 | A | 7/1965 | Vordahl |
| 3,752,655 | A | 8/1973 | Ramqvist |
| 3,941,903 | A | 3/1976 | Tucker, Jr. |
| 3,999,952 | A | 12/1976 | Kondo et al. |
| 4,145,213 | A | 3/1979 | Oskarsson et al. |
| 4,194,900 | A | 3/1980 | Ide et al. |
| 4,365,994 | A | 12/1982 | Ray |
| 4,379,852 | A | 4/1983 | Watanabe et al. |
| 4,397,800 | A | 8/1983 | Suzuki et al. |
| 4,401,724 | A | 8/1983 | Moskowitz et al. |
| 4,403,014 | A | 9/1983 | Bergmann |
| 4,419,130 | A | 12/1983 | Slaughter |
| 4,420,110 | A | 12/1983 | McCullough et al. |
| 4,426,423 | A | 1/1984 | Intrater et al. |
| 4,436,560 | A | 3/1984 | Fujita et al. |
| 4,439,236 | A | 3/1984 | Ray |
| 4,456,518 | A | 6/1984 | Bommaraju |
| 4,467,240 | A | 8/1984 | Futamoto et al. |
| 4,470,053 | A | 9/1984 | Maffitt et al. |
| 4,475,983 | A | 10/1984 | Bader et al. |
| 4,501,799 | A | 2/1985 | Driessen et al. |
| 4,505,746 | A | 3/1985 | Nakai et al. |
| 4,515,866 | A | 5/1985 | Okamoto et al. |
| 4,529,494 | A | 7/1985 | Joó et al. |
| 4,533,004 | A | 8/1985 | Ecer |
| 4,535,029 | A | 8/1985 | Intrater et al. |
| 4,545,968 | A | 10/1985 | Hirano et al. |
| 4,552,637 | A | 11/1985 | Viré et al. |
| 4,564,401 | A | 1/1986 | Strichman et al. |
| 4,564,555 | A | 1/1986 | Hornberger |
| 4,576,653 | A | 3/1986 | Ray |
| 4,596,994 | A | 6/1986 | Matsuda et al. |
| 4,610,550 | A | 9/1986 | Thomke et al. |
| 4,610,810 | A | 9/1986 | Hasegawa et al. |
| 4,615,913 | A | 10/1986 | Jones et al. |
| 4,626,464 | A | 12/1986 | Jachowski et al. |
| 4,643,951 | A | 2/1987 | Keem et al. |
| 4,652,710 | A | 3/1987 | Karnowsky et al. |
| 4,670,408 | A | 6/1987 | Petzow et al. |
| 4,671,822 | A | 6/1987 | Hamashima et al. |
| 4,673,550 | A | 6/1987 | Dallaire et al. |
| 4,681,671 | A | 7/1987 | Duruz |
| 4,690,796 | A | 9/1987 | Paliwal |
| 4,696,764 | A | 9/1987 | Yamazaki |
| 4,707,384 | A | 11/1987 | Schachner et al. |
| 4,710,348 | A | 12/1987 | Brupbacher et al. |
| 4,711,660 | A | 12/1987 | Kemp, Jr. et al. |
| 4,717,534 | A | 1/1988 | Morita |
| 4,718,941 | A | 1/1988 | Halverson et al. |
| 4,721,878 | A | 1/1988 | Hagiwara et al. |

(Continued)

FOREIGN PATENT DOCUMENTS

| | | |
|---|---|---|
| DE | 1136495 | 9/1955 |

(Continued)

OTHER PUBLICATIONS

U.S. Appl. No. 11/293,728, filed Dec. 2, 2005, Commonly owned co-pending application.

(Continued)

*Primary Examiner* — Sheeba Ahmed
(74) *Attorney, Agent, or Firm* — Robert A. Migliorini

(57) ABSTRACT

Multimodal cermet compositions having lower melting point metal binders and methods of making are provided. The multimodal cermet compositions having a low melting point metal binder include: a) a ceramic phase, and b) a low melting point metal binder phase, wherein the ceramic phase is a metal boride with a multimodal distribution of particles, wherein the metal of the metal boride is chosen from Group IV, Group V, Group VI elements of the Long Form of the Periodic Table of Elements, and mixtures thereof, and wherein the low melting metal binder phase is represented by the formula (DEF), wherein D is a base metal chosen from Fe, Ni, Co, Mn and mixtures thereof, E is an alloying metal comprising Cr, Si, and B, and F is an alloying element chosen from C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and wherein said low melting metal binder phase has a melting point less than 1250° C. The multimodal cermet compositions having a low melting point metal binder may be formed by a powder metallurgy process or an infiltration process. One or more advantages of the multimodal cermets with low melting point binder are high packing density of the ceramic phase, high fracture toughness, and improved erosion resistance at high temperatures up to 1000° C. The multimodal cermets with low melting point binder are suitable in high temperature erosion/corrosion applications in various chemical and petroleum environments.

52 Claims, 7 Drawing Sheets

U.S. PATENT DOCUMENTS

| | | | |
|---|---|---|---|
| 4,725,508 | A | 2/1988 | Rangaswamy et al. |
| 4,729,504 | A | 3/1988 | Edamura |
| 4,734,339 | A | 3/1988 | Schachner et al. |
| 4,744,947 | A | 5/1988 | Nilmen et al. |
| 4,751,048 | A | 6/1988 | Christodoulou et al. |
| 4,755,221 | A | 7/1988 | Paliwal et al. |
| 4,761,344 | A | 8/1988 | Maki et al. |
| 4,767,729 | A | 8/1988 | Osman et al. |
| 4,790,873 | A | 12/1988 | Gesing et al. |
| 4,806,161 | A | 2/1989 | Fabiny et al. |
| 4,808,055 | A | 2/1989 | Wertz et al. |
| 4,833,041 | A | 5/1989 | McComas |
| 4,836,982 | A | 6/1989 | Brupbacher et al. |
| 4,838,936 | A | 6/1989 | Akechi |
| 4,843,206 | A | 6/1989 | Azuma et al. |
| 4,847,025 | A | 7/1989 | White et al. |
| 4,851,375 | A | 7/1989 | Newkirk et al. |
| 4,859,124 | A | 8/1989 | Moskowitz et al. |
| 4,873,038 | A | 10/1989 | Rapp et al. |
| 4,880,600 | A | 11/1989 | Moskowitz et al. |
| 4,885,030 | A | 12/1989 | Moskowitz et al. |
| 4,889,745 | A | 12/1989 | Sata |
| 4,915,902 | A | 4/1990 | Brupbacher et al. |
| 4,915,908 | A | 4/1990 | Nagle et al. |
| 4,916,030 | A | 4/1990 | Christodoulou et al. |
| 4,929,513 | A | 5/1990 | Kyono et al. |
| 4,935,055 | A | 6/1990 | Aghajanian et al. |
| 4,948,676 | A | 8/1990 | Darracq et al. |
| 4,950,327 | A | 8/1990 | Eck et al. |
| 4,966,626 | A | 10/1990 | Fujiki et al. |
| 4,970,092 | A | 11/1990 | Gavrilov et al. |
| 4,995,444 | A | 2/1991 | Jolly et al. |
| 4,999,050 | A | 3/1991 | Sanchez-Caldera et al. |
| 5,004,036 | A | 4/1991 | Becker |
| 5,010,945 | A | 4/1991 | Burke |
| 5,020,584 | A | 6/1991 | Aghajanian et al. |
| 5,045,512 | A | 9/1991 | Lange et al. |
| 5,051,382 | A | 9/1991 | Newkirk et al. |
| 5,059,490 | A | 10/1991 | Brupbacher et al. |
| 5,217,816 | A | 6/1993 | Brupbacher et al. |
| 5,336,527 | A | 8/1994 | Takahashi et al. |
| 5,409,518 | A | 4/1995 | Saito et al. |
| 5,520,879 | A | 5/1996 | Saito et al. |
| 5,744,254 | A | 4/1998 | Kampe et al. |
| 5,854,434 | A | 12/1998 | Saito et al. |
| 5,854,966 | A | 12/1998 | Kampe et al. |
| 5,981,081 | A | 11/1999 | Sue |
| 6,022,508 | A | 2/2000 | Berns |
| 6,193,928 | B1 | 2/2001 | Rauscher et al. |
| 6,228,185 | B1 | 5/2001 | Davies et al. |
| 6,290,748 | B1 | 9/2001 | Jha et al. |
| 6,372,012 | B1 | 4/2002 | Majagi et al. |
| 6,544,636 | B1 | 4/2003 | Fukunaga et al. |
| 6,615,935 | B2 | 9/2003 | Fang et al. |
| 7,074,253 | B2 | 7/2006 | Chun et al. |
| 7,153,338 | B2 | 12/2006 | Bangaru et al. |
| 7,175,686 | B2 | 2/2007 | Chun et al. |
| 7,175,687 | B2 | 2/2007 | Bangaru et al. |
| 7,247,186 | B1 | 7/2007 | Chun et al. |
| 7,288,132 | B2 | 10/2007 | Chun et al. |
| 7,316,724 | B2 | 1/2008 | Bangaru et al. |
| 7,384,444 | B2 * | 6/2008 | Bangaru et al. ..... 75/244 |
| 7,422,804 | B2 | 9/2008 | Chun et al. |
| 7,431,777 | B1 | 10/2008 | Chun et al. |
| 7,438,741 | B1 | 10/2008 | Bangaru et al. |
| 2002/0162691 | A1 | 11/2002 | Fang et al. |
| 2007/0128066 | A1 | 6/2007 | Chun et al. |
| 2007/0151415 | A1 | 7/2007 | Chun et al. |

FOREIGN PATENT DOCUMENTS

| | | | |
|---|---|---|---|
| EP | 0115688 | A2 | 8/1984 |
| EP | 0426608 | | 5/1991 |
| EP | 0659894 | | 2/1995 |
| GB | 1404734 | | 9/1975 |
| GB | 1486964 | | 9/1977 |
| GB | 2109409 | | 6/1983 |
| JP | 51-55708 | | 5/1976 |
| JP | 55-65342 | | 5/1980 |
| JP | 55-79801 | | 6/1980 |
| JP | 56-8904 | | 1/1981 |
| JP | 56-23256 | | 5/1981 |
| JP | 56-55534 | | 5/1981 |
| JP | 59-222556 | | 12/1984 |

OTHER PUBLICATIONS

U.S. Appl. No. 11/479,680, filed Jun. 30, 2006, Commonly owned co-pending application.

S. S. Ordan'yan et al., Temperature Dependence of the Strength of Sintered TiB2-Fe Composites, Leningrad Technical Institute, UDC 621,762, No. 7 (235), pp. 94-97, Jul. 1982. Original article submitted Jan. 12, 1981 [595-597].

* cited by examiner

BIMODAL AND MULTIMODAL DENSE BORIDE CERMETS WITH LOW MELTING POINT BINDER

CROSS-REFERENCE TO RELATED APPLICATIONS

This is a Non-Provisional Application that claims priority to U.S. Provisional Application 61/003,800 filed Nov. 20, 2007, which is herein incorporated by reference.

FIELD

The present disclosure relates to cermet materials comprising a metal boride. More particularly, the present disclosure relates to cermet materials comprising $TiB_2$ with a bimodal or multimodal grit distribution and a low melting point metal binder for enabling infiltration of molten metal binder into a ceramic preform. These cermets are suitable for high temperature applications wherein materials with superior erosion resistance, fracture toughness and corrosion resistance are required and may be formed into complex shapes.

BACKGROUND

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are used currently for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials is chemically bonded castable alumina refractories. These castable alumina refractories are applied to the surfaces in need of protection and upon heat curing hardens and adheres to the surface via metal-anchors or metal-reinforcements. It also readily bonds to other refractory surfaces. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spalling.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

U.S. patent application Ser. No. 10/829,816 filed on Apr. 22, 2004 to Bangaru et al. discloses cermet compositions with improved erosion and corrosion resistance under high temperature conditions, and a method of making thereof. The improved cermet composition is represented by the formula (PQ)(RS) comprising: a ceramic phase (PQ) and binder phase (RS) wherein, P is at least one metal selected from the group consisting of Group IV, Group V, Group VI elements, Q is boride, R is selected from the group consisting of Fe, Ni, Co, Mn and mixtures thereof, and S comprises at least one element selected from Cr, Al, Si and Y. The ceramic phase disclosed is in the form of a monomodal grit distribution. U.S. patent application Ser. No. 10/829,816 is incorporated herein by reference in its entirety.

U.S. patent application Ser. No. 11/293,728 filed on Dec. 2, 2005 to Chun et al. discloses a bimodal and multimodal cermet compositions comprising: a) a ceramic phase, and b) a metal binder phase, wherein said ceramic phase is a metal boride with a multimodal distribution of particles, wherein at least one metal is selected from the group consisting of Group IV, Group V, Group VI elements of the Long Form of the Periodic Table of Elements and mixtures thereof, and wherein said metal binder phase comprises at least one first element selected from the group consisting of Fe, Ni, Co, Mn and mixtures thereof, and at least one second element selected from the group consisting of Cr, Al, Si and Y, and Ti. The ceramic phase disclosed is in the form of bimodal and multimodal grit distribution. The cermet compositions having bimodal and multimodal ceramic grit distribution revealed superior erosion resistance, fracture toughness and corrosion resistance. U.S. patent application Ser. No. 11/293,728 is incorporated herein by reference in its entirety.

A need exists for cermet materials with complex shapes having high density, high fracture toughness and improved erosion and corrosion resistance properties for high temperature applications. The new and improved bimodal and multimodal cermet compositions having lower melting point metal binders of the present disclosure satisfy this need. Furthermore, the present disclosure includes infiltration methods of making the new and improved bimodal and multimodal cermet compositions having lower melting point metal binders. The present disclosure also includes methods for protecting metal surfaces with bimodal or multimodal cermet compositions having lower melting point metal binders against erosion and corrosion under high temperature conditions.

SUMMARY

According to the present disclosure, an advantageous multimodal cermet composition comprises: a) a ceramic phase, and b) a low melting point metal binder phase, wherein said ceramic phase is a metal boride with a multimodal distribution of particles, wherein the metal of the metal boride is chosen from Group IV, Group V, Group VI elements of the Long Form of the Periodic Table of Elements, and mixtures thereof, and wherein said low melting metal binder phase is represented by the formula (DEF), wherein D is a base metal chosen from Fe, Ni, Co, Mn and mixtures thereof, E is an alloying metal comprising Cr, Si, and B, and F is an alloying element chosen from C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and wherein said low melting metal binder phase has a melting point less than 1250° C.

A further aspect of the present disclosure relates to an advantageous bimodal cermet composition comprising: a) a $TiB_2$ phase with a bimodal distribution of particles in the size range of 3 to 60 microns and 61 to 800 microns; b) a $M_2B$ phase wherein M is chosen from Cr, Fe, Ni, Ti and combinations thereof; c) an impurity phase chosen from $TiO_2$, TiC, TiN, Ti(C,N), and combinations thereof; d) a $M_xSi_y$ phase wherein M is chosen from Fe, Ni, Cr, Ti and combinations thereof; and e) a low melting point metal binder phase represented by the formula (DEF), wherein D is a base metal chosen from Fe, Ni, Co, Mn and mixtures thereof, E is an alloying metal comprising Cr, Si, and B, and F is an alloying element chosen from C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and wherein said low melting metal binder phase has a melting point less than 1250° C.

A further aspect of the present disclosure relates to an advantageous method for protecting a metal surface subject to erosion at temperatures up to 1000° C., the method comprising providing a metal surface with a multimodal cermet composition, wherein said composition comprises: a) a ceramic phase, and b) a low melting point metal binder phase, wherein said ceramic phase is a metal boride with a multimodal distribution of particles, wherein the metal of the metal boride is chosen from Group IV, Group V, Group VI elements of the Long Form of the Periodic Table of Elements, and mixtures thereof, and wherein said low melting metal binder phase is represented by the formula (DEF), wherein D is a base metal chosen from Fe, Ni, Co, Mn and mixtures thereof, E is an alloying metal comprising Cr, Si, and B, and F is an alloying element chosen from C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and wherein said low melting metal binder phase has a melting point less than 1250° C.

Another aspect of the present disclosure relates to an advantageous method for protecting a metal surface subject to erosion at temperatures up to 1000° C. with a bimodal boride cermet composition, the method comprising providing a metal surface with a bimodal boride cermet composition, wherein said composition comprises: a) a $TiB_2$ phase with a bimodal distribution of particles in the size range of 3 to 60 microns and 61 to 800 microns; b) a $M_2B$ phase wherein M is chosen from Cr, Fe, Ni, Ti and combinations thereof; c) an impurity phase chosen from $TiO_2$, TiC, TiN, Ti(C,N), and combinations thereof; d) a $M_xSi_y$ phase wherein M is chosen from Fe, Ni, Cr, Ti and combinations thereof; and e) a low melting point metal binder phase represented by the formula (DEF), wherein D is a base metal chosen from Fe, Ni, Co, Mn and mixtures thereof, E is an alloying metal comprising Cr, Si, and B, and F is an alloying element chosen from C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, and wherein said low melting metal binder phase has a melting point less than 1250° C.

These and other features and attributes of the multimodal and bimodal cermet compositions comprising: a) a ceramic phase with a multimodal or bimodal distribution of particles, and b) a low melting metal binder phase of the present disclosure and their advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DETAILED DESCRIPTION

Figure 1:
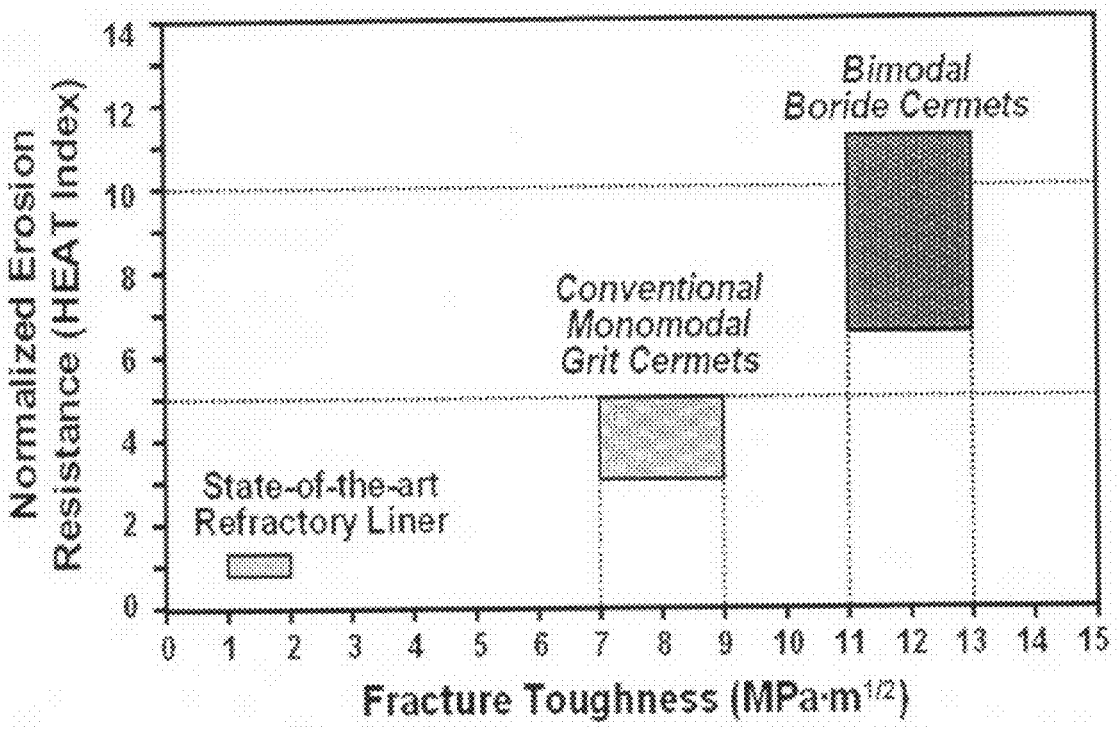
FIG. 1 depicts the improved erosion resistance and high fracture toughness of bimodal boride cermets of the present disclosure as measured by the HEAT index in comparison to conventional monomodal cermets and state-of-the-art refractory liner.

The present disclosure provides multimodal and bimodal cermet compositions having lower melting point metal binders comprising: a) a ceramic phase with a multimodal or bimodal distribution of particles, and b) a low metal point binder phase. The multimodal or bimodal cermet compositions having low melting point metal binders of the present disclosure are distinguishable from the prior art in comprising a ceramic phase with a multimodal or bimodal grit distribution suitably designed for close packing, and corresponding high density of the ceramic phase particles within the metal binder phase as well as a low melting binder phase conducive for infiltration processing for forming into complex shapes. The advantageous properties and/or characteristics of the multimodal or bimodal cermet compositions having lower melting point metal binders are based in part on the closest packing of the ceramic phase particles, wherein one mode of particle distribution includes a coarse particle (grit) average size in excess of 200 microns for step-out erosion performance, including, inter alia, improved fracture toughness and erosion resistance over conventional cermets with a monomodal grit distribution. The advantageous properties and/or characteristics of the bimodal cermet compositions having lower melting point metal binders are also based in part on the lower melting point metal binders, i.e. the melting point of metal binders is lower than that of conventional carbon steels and stainless steels, thereby enables infiltration methods of making the same bimodal cermet compositions having lower melting point metal binders. All numerical values within the detailed description and the claims herein are understood as modified by "about." As used herein, bimodal distribution refers to two distinct distributions and multimodal refers to two or more (two, three, four, five, etc.) distinct distributions.

Materials such as ceramics are primarily elastic solids and cannot deform plastically. They undergo cracking and fracture when subjected to large tensile stress such as induced by solid particle impact of erosion process when these stresses exceed the cohesive strength (fracture toughness) of the ceramic. Increased fracture toughness is indicative of higher cohesive strength. During solid particle erosion, the impact force of the solid particles cause localized cracking, known as Hertzian cracks, at the surface along planes subject to maximum tensile stress. With continuing impacts, these cracks propagate, eventually link together, and detach as small fragments from the surface. This Hertzian cracking and subsequent lateral crack growth under particle impact has been observed to be the primary erosion mechanism in ceramic materials. Of all the ceramics, titanium diboride ($TiB_2$) has exceptional fracture toughness rivaling that of diamond but with greater chemical stability (reference Gareth Thomas Symposium on Microstructure Design of Advanced Materials, 2002 TMS Fall Meeting, Columbus Ohio, entitled "Microstructure Design of Composite Materials: WC-Co Cermets and their Novel Architectures" by K. S. Ravichandran and Z. Fang, Dept. of Metallurgical Eng., Univ. of Utah).

In cermets, cracking of the ceramic phase initiates the erosion damage process. For a given erodant and erosion conditions, key factors governing the material erosion rate (E) are hardness and toughness of the material as shown in the following equation where $K_{IC}$ and H are respectively fracture toughness and hardness of target material, and q is an experimentally determined number.

$$E \propto (K_{IC})^{-4/3} \cdot H^q$$

Cermets with bimodal $TiB_2$ grit distribution (bimodal boride cermets) suitably designed for closest packing can provide simultaneously high density, high fracture toughness and improved erosion resistance over conventional cermets with monomodal grit distribution. Coarse grit typically greater than the size of impinging particles provides superior erosion resistance. Fine grit that fits the gap created between coarse grit provides close packing and corresponding high packing density. The free volume space generated by bimodal grit packing provides the volume required for the metal binder phase to minimize porosity. The contiguity of metal binder phase imparts high fracture toughness. The fine grit also serves to protect the binder region from excessive, selective erosion that can take place in this region in the absence of the fine grit. Utilizing commercially available grit sizes in the range of 3 to 60 microns and 61 to 800 microns (bimodal approach) yields an advantageous dense packing of the grit. However, the instant disclosure is not limited to a bimodal grit distribution approach, but may include trimodal and other multi-modal approaches to further maximize packing density of the boride particles via the utilization of a third or more distribution of grit sizes. A trimodal approach is defined as including three different distributions of grit size. A multimodal approach is defined as including two or more different distributions of grit size.

These advantages of bimodal boride cermets are illustrated in FIG. 1, wherein normalized erosion resistance measured by Hot Erosion/Attrition Test (HEAT) is plotted against fracture toughness. By definition, normalized erosion resistance of the state-of-the-art refractory liner is 1. The fracture toughness of this castable alumina refractory is about 1~2 MPa·m½. Conventional monomodal grit cermets show improved erosion resistance (up to 5) and fracture toughness of 7~9 MPa·m½. Bimodal boride cermets of the instant disclosure yield further improvements in both erosion resistance (up to 11) and fracture toughness (11~13 MPa·m½).

One or more advantages may result from use of the multimodal and bimodal cermet compositions comprising: a) a ceramic phase with a multimodal or bimodal distribution of particles, and b) a low melting binder phase disclosed herein. One or more of these advantages include, but is not limited to, higher packing density than conventional cermets with a monomodal grit distribution, improved fracture toughness in comparison to similar cermets with a monomodal grit distribution, improved erosion resistance in comparison to similar cermets with a monomodal grit distribution, outstanding hardness, good corrosion resistance, excellent stability at high temperatures from thermal degradation in its microstructure (thus making them highly desirable and unique for long term service in high temperature process applications), and excellent formability into complex shapes via the infiltration method. These one or more advantages of the multimodal cermet compositions with low melting point binder disclosed herein result in beneficial application in apparatus and reactor systems that are in contact with hydrocarbon environments at any time during use, including reactors, regenerators, internal cyclones, and process piping. They may be used to construct the surface of apparatus or applied onto the surface of apparatus exposed to aggressive erosion environments at high temperature.

Ceramic Phase Component

One component of the bimodal cermet composition having lower melting point metal binders is the ceramic phase. Due to their irregular and complex shapes, these ceramic particles are not amenable to theoretical modeling of packing. Tap density measurement determines the proper ratio of coarse and fine $TiB_2$ grits for bimodal boride cermets for the highest packing density. In one non-limiting exemplary embodiment, the average particle size of the coarse $TiB_2$ grit is about 200 microns and the average particle size of the fine $TiB_2$ grit is about 15 microns. The particle size distribution of coarse grit is in the range of about 100 to about 800 microns in diameter. Particle size diameter is defined by the measure of longest axis of the 3-D shaped particle. Microscopy methods such as optical microscopy (OM) and scanning electron microscopy (SEM) may be used to determine the particle sizes. The dispersed ceramic particles can be any shape. Some non-limiting examples of the shape include spherical, ellipsoidal, polyhedral, distorted spherical, distorted ellipsoidal and distorted polyhedral shaped. The particle shape of coarse grit must be devoid of agglomerates of fine grits, termed as "raspberry" particles. The raspberry morphology of coarse grit is detrimental to achieving many advantages of bimodal cermet compositions described in this disclosure. A non-limiting example of a bimodal grit includes 50% coarse grit with an average particle size of 200 microns, and 50% fine grit with an average particle size of 15 microns. This bimodal mix provides a high tap density of about 3.0 g/cc and a low free volume of about 34%.

The bimodal boride cermets of the present disclosure utilize suitable bimodal $TiB_2$ grits in the required volume ratio. Table 1 depicts exemplary coarse and fine $TiB_2$ grits used for producing bimodal boride cermets having a high packing density, improved fracture toughness, and enhanced erosion performance.

TABLE 1

| Company | Grade | Chemistry (wt %) | Size |
|---|---|---|---|
| H. C. Starck | S (fine grit) | Ti: Balance, B: 31.2%, C: 0.4%, O: 0.1%, N: 0.01%, Fe: 0.06% (Development product, Similar to Lot 50356) | $D_{10}$ = 7.68 μm, $D_{50}$ = 16.32 μm, $D_{90}$ = 26.03 μm |
| H. C. Starck | S2ELG (coarse grit) | Ti: Balance, B: 31.2%, C: 0.9%, O: 0.04%, N: 0.02%, Fe: 0.09% (Development product: Similar to Lot 50216) | +106-800 μm |

Figure 2:
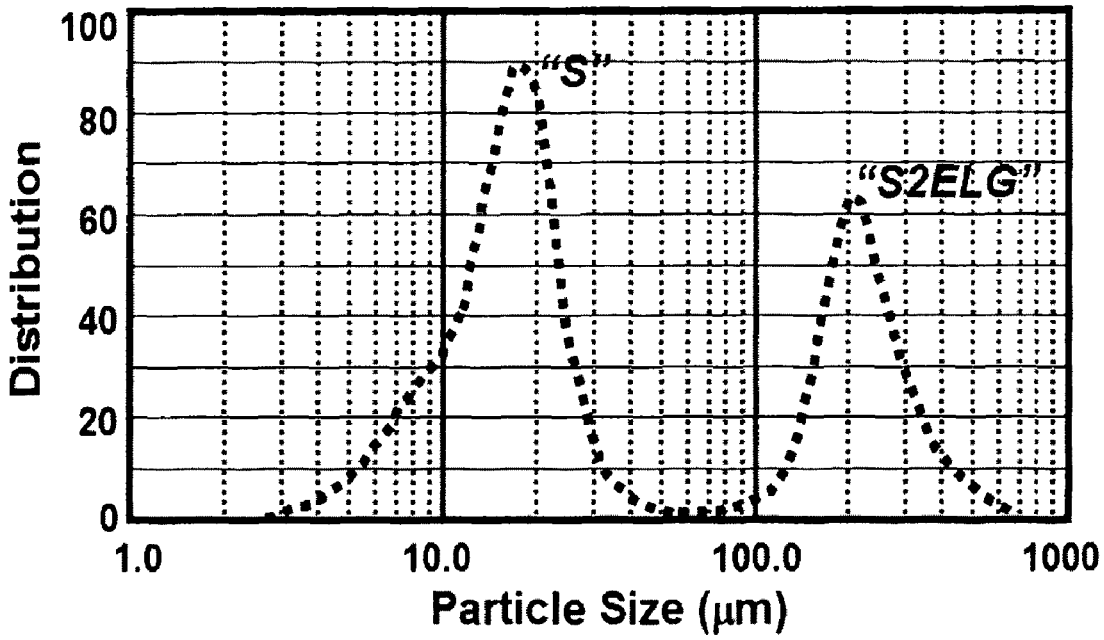
FIG. 2 depicts a particle size distribution plot of an exemplary bimodal titanium diboride grit used herein.

FIG. 2 is a particle size distribution plot of the bimodal $TiB_2$ grits shown in Table 1. Laser diffraction analysis using a unified scatter technique (microtrac×100) was used to generate the bimodal grit distribution. The bimodal $TiB_2$ grit distribution depicts that the average particle size of the coarse $TiB_2$ grit is about 200 microns and the average particle size of the fine $TiB_2$ grit is about 15 microns.

The particle size distribution of the coarse $TiB_2$ grit can be further determined by a sieve classification method. The coarse $TiB_2$ grit is sized to obtain close packing. In this case mesh size is used as a measurement of particle size. It is obtained by sieving various sized particles through a screen (mesh). A mesh number indicates the number of openings in a screen per square inch. In other words, a mesh size of 100 would use a screen that has 10 wires per linear inch in both a horizontal and vertical orientation yielding 100 openings per square inch. A "+" before the mesh size indicates that particles are retained on and are larger than the sieve. A "−" before the mesh size indicates the particles pass through and are smaller than the sieve. For example, −45 mesh indicates the particles pass through and are smaller than the openings of a 45 mesh (355 mm) sieve. Typically 90% or more of the particles will fall within the specified mesh. Often times, mesh size is expressed by two numbers (i.e., +60/−45). This translates to a range in particle sizes that will fit between two screens. The top screen will have 45 openings per square inch and the bottom screen will have 60 openings per square inch. For example, one could narrow down the range of particle sizes in a batch of packing material to contain particles from 250 mm to 355 mm. First, sieve it through a screen with a mesh size of 45 (45 openings per square inch) which particles smaller than 355 mm will pass through. Then, use a second screen with a mesh size of 60 (60 openings per square inch), after the first mesh, and particles smaller than 250 mm will pass through. Between the two screens would be retained a range of particles from 250 mm to 355 mm. This batch of ceramic could then be expressed as having a mesh size of +60/−45. Table 2 shows a particle size distribution of coarse $TiB_2$ grit (H. C. Starck's S2ELG Grade) used for producing closely packed $TiB_2$ cermet of the instant disclosure.

TABLE 2

| $TiB_2$ Mesh Size | Approximate Micron Size (mm) | Volume Fraction (%) |
|---|---|---|
| +45 | +355 | 17.3 |
| +60/−45 | +250/−355 | 23.4 |
| +140/−60 | +106/−250 | 58.7 |
| +200/−140 | +75/−106 | 0.3 |
| +200 | −75 | 0.3 |
| | Total | 100 |

Tap density measurement based on ASTM B527 determines the proper ratio of both coarse and fine $TiB_2$ grits for bimodal boride cermets. In one non-limiting exemplary embodiment, a $TiB_2$ mixture of both coarse and fine grits at the ratio of 50 vol % coarse (H. C. Starck's S2ELG Grade) and 50 vol % fine (H. C. Starck's S Grade) provides the highest tap density (3.00 g/cc) and the lowest free volume (34.0%). The required volume percent of a metal binder powder to produce bimodal boride cermets is determined by the lowest free volume.

Table 3 depicts another exemplary coarse and fine $TiB_2$ grits used for producing bimodal boride cermets having a high packing density. The bimodal premix powder supplied from Sintec-Keramik (Development product, Lot PWT2S1-1963) was further screened to separate both fine and coarse grits.

TABLE 3

| Company | Grade | Chemistry (wt %) | Size |
|---|---|---|---|
| Sintec-Keramik | Fine | Ti: Balance, B: 30.2%, C: 0.02%, O: 0.2%, N: 0.2%, Ca: 0.05% (Sieved from the Lot PWT2S1-1963) | −53 μm (below 270 mesh) |
| Sintec-Keramik | Coarse | Ti: Balance, B: 30.2%, C: 0.02%, O: 0.2%, N: 0.2%, Ca: 0.05% (Sieved from the Lot PWT2S1-1963) | +106-800 μm (above 140 mesh) |

Table 4 depicts the particle size distribution of Sintec-Keramik's coarse $TiB_2$ grit used for producing closely packed $TiB_2$ cermet of the instant disclosure.

TABLE 4

| $TiB_2$ Mesh Size | Approximate Micron Size (mm) | Volume Fraction (%) |
|---|---|---|
| +45 | +355 | 36.9 |
| +60/−45 | +250/−355 | 49.2 |
| +140/−60 | +106/−250 | 13.9 |
| | Total | 100 |

Tap density and free volume were measured for various $TiB_2$ grit mixtures to determine the proper ratio of coarse and fine $TiB_2$ grits for bimodal boride cermets. The coarse grits used were particles screened above 140 mesh (106 mm) from the original bimodal premix lot PWT2S1-1963. The fine grits used were particles screened below 270 mesh (53 mm) from the original bimodal premix lot PWT2S1-1963. Table 5 depicts the results of tap density measurement through the use of Sintec-Keramik's $TiB_2$ grits.

TABLE 5

| Volume % of $TiB_2$ Grits, Coarse:Fine | Tap Density (g/cc) | Free Volume (%) |
|---|---|---|
| 50:50 | 2.60 | 38.5 |
| 55:45 | 2.72 | 36.8 |
| 60:40 | 3.14 | 31.8 |
| 65:35 | 2.92 | 34.3 |

Table 6 depicts another exemplary coarse and fine $TiB_2$ grits used for producing bimodal boride cermets having a high packing density.

TABLE 6

| Company | Grade | Chemistry (wt %) | Size |
|---|---|---|---|
| ESK-Ceradyne | 411M20 (Fine) | Ti: Balance, B: 29.3%, C: 0.73%, O: 0.87%, N: 0.17%, Fe: 0.10% | $D_{s3}$ = 44.4 mm $D_{s50}$ = 17.4 mm $D_{s94}$ = 3.5 mm |
| ESK-Ceradyne | 408M3 (Coarse) | Ti: Balance, B: 29.5%, C: 1.11%, O: 0.61%, N: 0.18%, Fe: 0.16% | 99.9%-1000 mm |

Table 7 depicts the particle size distribution of ESK-Ceradyne's coarse $TiB_2$ grit (Grade 408M3) used for producing closely packed $TiB_2$ cermet in this disclosure. Fine grits screened below 200 mesh (75 mm) were discarded.

TABLE 7

| $TiB_2$ Mesh Size | Approximate Micron Size (mm) | Volume Fraction (%) |
|---|---|---|
| +45 | +355 | 25.9 |
| +60/−45 | +250/−355 | 17.1 |
| +140/−60 | +106/−250 | 31.0 |
| +200/−140 | +75/−106 | 16.0 |
| | Total | 100 |

Tap density and free volume have measured for various $TiB_2$ grit mixtures to determine the proper ratio of coarse and fine $TiB_2$ grits for bimodal boride cermets. The coarse grits used were particles screened above 200 mesh (75 mm) from the original grade 408M3. The fine grits used were as-supplied grade 41 lM20. Table 8 depicts the results of tap density measurement through the use of ESK-Ceradyne's $TiB_2$ grits.

TABLE 8

| Volume % of $TiB_2$ Grits, Coarse:Fine | Tap Density (g/cc) | Free Volume (%) |
|---|---|---|
| 50:50 | 3.10 | 32.3 |
| 55:45 | 3.15 | 31.7 |
| 60:40 | 3.20 | 31.3 |
| 65:35 | 3.15 | 31.7 |

Metal Binder Phase Component

Another component of the bimodal boride cermet composition having lower melting point metal binders is a metal binder phase. The lower melting point metal binder phase is represented by the formula (DEF), wherein D is the base metal selected from the group consisting of Fe, Ni, Co, Mn and mixtures thereof, E is the alloying metal comprising Cr, Si, and B, and F is the alloying element selected from the group consisting of C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag and Au.

In one advantageous form of the present disclosure, the base metal D is Fe. Iron based alloy is more resistant to high temperature sulfidation corrosion than nickel based alloys. Thus, the base metal D contains less than 45 wt % of Ni, and more advantageously less than 35 wt % of Ni based on the total weight of the lower melting point metal binder (DEF). The nickel content of the base metal of the present disclosure is ideally maintained at low levels so as to lower the cost of the lower melting point metal binder. The reduced nickel content allows for substantial initial wetting of the metal binder due to the low melting point of nickel while at the same time minimizing the cost of the lower melting point metal binder.

Chromium is a desirable alloying metal E for inclusion in the lower melting point metal binder (DEF) in that it tends to protect the metal binder and the cermet composition from the corrosive environments of usage. The Cr content may vary from 5 to 40 wt %, or 10 to 30 wt %, or 15 to 25 wt % based on the total weight of the lower melting point metal binder (DEF). The Cr and Si metals provide for enhanced corrosion resistance in the temperature range of 25° C. to 850° C. Silicon and/or boron are added to the lower melting point metal binder (DEF) to depress the melting point, which enables infiltration during cermet fabrication. The Si content may vary from 0.5 to 8 wt %, or 2.5 to 8 wt %, or 3.5 to 8 wt % based on the total weight of the lower melting point metal binder (DEF). The B content may vary from 0.5 to 8 wt %, or 1.5 to 7 wt %, or 2.5 to 6 wt % based on the total weight of the lower melting point metal binder (DEF).

The presence of carbon as an alloying element F aids in the use of lower melting point metal binder of the present disclosure. In excessive amounts it is detrimental in that it tends to embrittle the lower melting point metal binder. Therefore, the lower melting point metal binder of the present disclosure should include a maximum wt % carbon of 0.5%, or less than or equal to 0.4 wt %, or less than or equal to 0.3 wt %, or less than or equal to 0.2 wt %, and in an advantageous embodiment the carbon level should be less than 0.1%. In one exemplary embodiment, Ti is in the range of from about 0.1 to about 3.0 wt %, or 0.1 to 2.0 wt %, or 0.1 to 1.0 wt % based on the weight of the lower melting point metal binder (DEF). Ti facilitates wetting of the lower melting point binder during cermet fabrication and suppresses the formation of $M_2B$ phase.

A non-limiting list of the lower melting point metal binder (DEF) for use in the present disclosure is presented in Table 9. These lower melting point metal binders are suitable for making advantageous bimodal and multimodal dense boride cermets having lower melting point metal binders for high temperature erosion and corrosion applications.

TABLE 9

| Metal Binder (DEF) | Alloy Composition (Weight %) | Melting Point (° C.) |
|---|---|---|
| Alloy 1 | Bal. Fe:20Ni:6Cr:6Si:4B | 1076.4 |
| Alloy 2 | Bal. Fe:20Ni:18Cr:5B | |
| Alloy 3 | Bal. Fe:33Ni:18Cr:5B | |
| Alloy 4 | Bal. Fe:20Ni:18Cr:6Si:5B | 1096.4 |
| Alloy 5 | Bal. Fe:20Ni:18Cr:6Si:4B:0.1C | 1102.6 |

Figure 3:
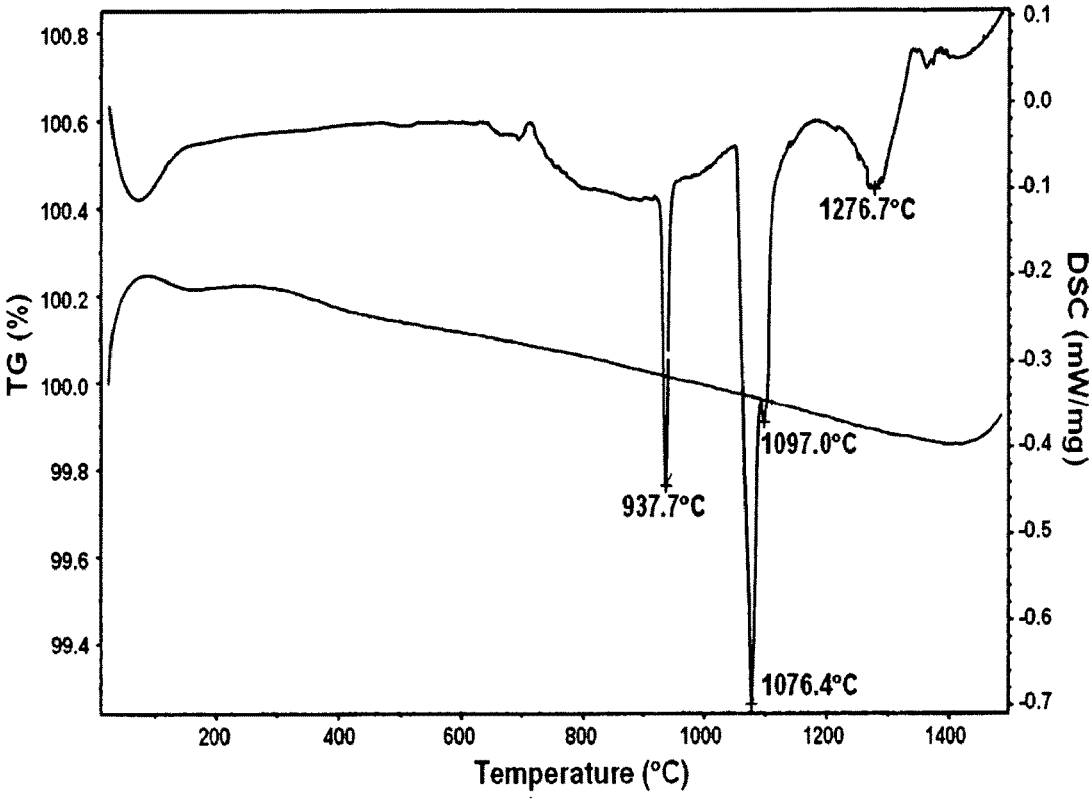
FIG. 3 depicts TG/DSC plot of a 64Fe:2ONi:6Cr:6Si:4B metal binder phase revealing a lower melting point at 1076.4° C.

The melting point of the metal binder can be determined by a simultaneous thermogravimetric (TG)-differential scanning calorimetric (DSC) measurements known to one skilled in the art. One may extend the standard test procedure being used for polymers to the metal binder of the instant disclosure. ASTM D3418 is a standard test method for determining transition temperatures of polymers by differential scanning calorimetry. FIG. 3 depicts TG/DSC result of the alloyl having composition of 64Fe:2ONi:6Cr:6Si:4B. About 150 mg specimen of the alloy 1 was placed in a sample holder of Netzch DIL 402C TG-DSC unit and heated to 1500° C. while monitoring mass change, exothermic and endothermic reactions. The melting point was determined by reading the temperature showing the strongest endothermic peak.

One non-limiting example of such a lower melting point metal binder is the metal binder having the melting point less than 1250° C., or less than 1200° C., and advantageously less than 1150° C. These melting points are much lower than those of carbon steels (1536° C.) and 304 stainless steels (1450° C.) and much higher than the process temperatures (750° C.) that the bimodal boride cermets having lower melting point metal binders are utilized. Therefore, lower melting point metal binders can be used as brazing cloth, which shall be discussed in detail subsequently.

The lower melting point metal binder content may be in the range of 5 to 40 vol %, or 10 to 40 vol %, or 20 to 40 vol %, or 30 to 40 vol % based on the volume of the cermet. In general, higher volume percentages of the lower melting point metal binder are advantageous.

Other Components

The bimodal $TiB_2$ cermet composition having lower melting point metal binders may further comprise secondary metal borides, wherein the metal is chosen from Group IV, Group V, Group VI elements of the Long Form of the Periodic Table of Elements, Fe, Ni, Co and Mn. The secondary metal borides are primarily derived from the metal elements from the boride ceramic phase and the lower melting point metal binder phase after sintering or infiltration at elevated temperatures. The secondary metal borides are formed by dissolution of a boride phase into a liquid metal binder phase during sintering or infiltration and reprecipitation with other metal constituents during subsequent cooing. As a non-limiting example, the bimodal boride cermet composition may include a secondary boride $M_xB_y$, wherein the molar ratio of x:y can vary in the range of about 3:1 to about 1:6. For example, the bimodal $TiB_2$ cermet composition processed with Ti-containing metal binder comprises a secondary boride phase, $M_2B$, wherein M comprises Cr, Fe, Ni and Ti with other minor elements derived from the binder phase composition.

The total ceramic phase volume in the cermet of the instant disclosure includes both $TiB_2$ and the secondary borides, $M_2B$. In the bimodal $TiB_2$ cermet composition, the combined $TiB_2$ and $M_2B$ content ranges from 60 to 95 vol % based on the volume of the cermet, or from 60 to 90 vol % based on the volume of the cermet, and advantageously from 60 to 80 vol % based on the volume of the cermet. It has been found that the amount of $M_2B$ should be kept to a minimum, advantageously less than 10 vol % more advantageously less than 7 vol %, and still more advantageously, less than about 5 vol %, for superior erosion resistance and fracture toughness.

Another component of the bimodal boride cermet composition having lower melting point metal binders is an impurity phase. The impurity phase may include metal oxides chosen from Fe, Ni, Co, Mn, Al, Cr. Y, Si, Ti, Zr, Hf, V, Nb, Ta, Mo and W and mixtures thereof. The oxides are derived from the metal elements from elements of the boride ceramic phase and the metal binder phase. The impurity phase of the bimodal cermet composition may further include carbide, nitride, carbonitride phases and combinations thereof of a metal chosen from Fe, Ni, Co, Mn, Al, Cr, Y, Si, Ti, Zr, Hf, V, Nb, Ta, Mo and W and mixtures thereof. The carbide, nitride, carbonitride phases and combinations thereof are derived from the metal elements of the boride ceramic phase and the metal binder phase. As a non-limiting example, the bimodal $TiB_2$ cermet composition may include TiC, TiN and Ti(C,N) phases. Other impurity compounds may also be introduced from the commercial synthesis process. For example, the residual organic binder after binder burnout process and the carburizing and/or nitriding environments during sintering or infiltration process are responsible for imparting the presence of impurity phases. The bimodal boride cermet having lower melting point metal binders of the instant disclosure includes less than about 5 vol %, or less than 3 vol %, and advantageously less than about 2 vol %, of such impurity phases including both oxide, carbide, nitride, carbonitride phases and a combination thereof.

Another component of the bimodal boride cermet composition having lower melting point metal binders is a metal silicide phase represented by $M_xSi_y$, wherein M is chosen from Group IV, Group V, Group VI elements of the Long Form of the Periodic Table of Elements, Fe, Ni, Co, Mn and mixtures thereof. The molar ratio of x:y in a metal silicide $M_xSi_y$ can vary in the range of about 4:1 to about 1:2. A non-limiting list of such a metal silicide is presented in Table 10 with the emphasis of iron-silicide and nickel silicide.

TABLE 10

| Iron-silicide, $Fe_xSi_y$ | | Nickel-silicide, $Ni_xSi_y$ | |
|---|---|---|---|
| Phase | Composition Wt. % Si | Phase | Composition Wt. % Si |
| $Fe_2Si$ | ~20.1 | $b_1$-$Ni_4Si$ | 12.4~13.4 |
| $Fe_5Si_3$ | 23.2 | $b_3$-$Ni_3Si$ | ~13.4 to 14.1 |
| FeSi | ~34 | $b_2$-$Ni_3Si$ | ~13.4 to 14.1 |
| b-$FeSi_2$ | 53.4-58.2 | g-$Ni_{31}Si_{12}$ | 15.6 |
| a-$FeSi_2$ | 50.2 | q-$Ni_2Si$ | 19.4~25.0 |
| | | d-$Ni_2Si$ | 19.3 |
| | | e-$Ni_3Si_2$ | 23.0~25.0 |
| | | NiSi | 32.4 |
| | | b-$NiSi_2$ | 48.9 |
| | | a-$NiSi_2$ | 48.9 |

The bimodal boride cermet composition having lower melting point 5 metal binders of the instant disclosure includes less than 10 vol, advantageously less than 7 vol % and more advantageously less than 5 vol % of such a metal silicide phase represented by $M_xSi_y$. It has been found that the amount of $M_xSi_y$ should be kept to a minimum for superior erosion resistance and fracture toughness.

Another component of the bimodal boride cermet composition having lower melting point metal binders is an embrittling intermetallic precipitates such as a sigma phase. The bimodal boride cermet composition of the instant disclosure is responsible for imparting this attribute of avoidance of embrittling intermetallic precipitates. The bimodal boride cermet of the instant disclosure has less than 10 vol %, advantageously less than 7 vol % and more advantageously less than 5 vol % of such embrittling phases.

The volume percent of the cermet phase (and cermet components) of the present disclosure excludes pore volume due to porosity. The disclosed bimodal boride cermets having lower melting point metal binders are characterized by porosity of up to 15 vol %. Advantageously, the volume of porosity is less than 10% of the volume of the cermet and more advantageously less than 5% of the volume of the cermet. The pores constituting the porosity are advantageously not connected, but distributed in the cermet body as discrete pores. The mean pore size is advantageously equal to or less than the mean particle size of the ceramic phase.

Method For Producing

A method for producing bimodal cermet compositions comprising: a) a ceramic phase with a bimodal distribution of particles, and b) a lower melting point metal binder phase is also disclosed. The bimodal cermets having lower melting point metal binders can be produced by conventional powder metallurgical techniques including, but not limited to, the steps of mixing, milling, pressing, sintering and cooling. Bimodal ceramic grits of suitable size and lower melting point metal binder powder are mixed in a ball mill with an organic liquid for a time sufficient to adequately disperse the powders. A non-limiting exemplary milling time is 4 hours. Paraffin wax may also be added to a ball mill to provide green strength of the compact after the subsequent pressing process. An exemplary range of paraffin wax is from 2 to 4 wt % of the combined weight of both ceramic grit and the metal binder powder. After the milling process, the liquid is removed and the milled powder is dried. The amount of milling media in ball milling process is advantageously less than about 40% of the total powder added. A non-limiting example of a suitable milling media is yttria stabilized zirconia (YSZ) balls. If the amount of milling media is in excess of the above range, the milling step may introduce subcritical microcracks in the $TiB_2$ grits, which may further lead to chipping of coarse $TiB_2$ grits during use in high temperature erosion environments, and a corresponding degradation of erosion resistance.

In order to make a flowable powder mix, other mixing methods may be utilized. A non-limiting list of alternative mixing methods includes V-blending, spray drying, pucking and screening, Littleford mixing, Patterson-Kelley mixing, jar rolling and disc pelletizing. These alternative mixing methods provide a homogeneous distribution of the powder mix and make the powder mix flowable during the pressing process.

After the mixing and milling steps, the powder mix is placed in a die set and uniaxially pressed into a green body. In one non-limiting exemplary embodiment, the green body is in the shape of a tile of dimensions of 2.215×2.215×1.150 inches. The pressing tonnage is advantageously in the range of 10 to 100 tons, more advantageously in the range of 40 to 80 tons. The higher tonnage tends to create residual stress at the stress concentrating points and leads to higher cracking susceptibility in the green body due to spring back effect.

In order to heal any cracks that result from the uniaxially pressing for the production of green bodies, cold isostatic pressing (hereinafter "CIP") may be applied. An advantageous pressure of the CIP step is 30 kpsi. The green bodies are placed in a rubber bag, positioned in a hydraulic medium and subjected to an applied pressure isostatically. No cracking occurs within the green bodies processed by the additional CIP process.

The resulting green bodies of the present disclosure formed by mixing, uniaxial pressing, and optionally cold isostatic pressing are then subjected to a sintering step by loading them into a furnace. As a non-limiting example of a sintering step, the green bodies are placed on alumina plates sprinkled with alumina sand (about 20 grit size) and loaded into a box made out of graphite. The graphite boxes are loaded into the furnace. The green bodies are ramped up to about 400° C. at about 3° C./min and held at about 400° C. for 100 minutes before being ramped up to 600° C. at 3° C./min and held for 90 minutes. This process runs in cyclic argon and vacuum environments and burns out paraffin wax binders. The binder burnt out bodies are further ramped up to 1250° C. at 5° C./min and held for 180 minutes in an argon environment at this temperature. The liquid phase sintering temperature can be above 1150° C. and up to 1550° C. for times ranging from 10 minutes to 4 hours. The lower melting point of the metal binder significantly reduces the liquid phase sintering temperature. The sintering operation is advantageously performed in an inert atmosphere or a reducing atmosphere or under vacuum. For example, the inert atmosphere can be argon and the reducing atmosphere can be hydrogen. In one exemplary embodiment, the sintered bimodal cermet composition tile prepared according to the aforementioned process of the present disclosure is about 2×2×1 inches. The bimodal cermet sintered tiles can be further machined to meet the final size requirement. After sintering, the bimodal cermet composition having lower melting point metal binders is subjected to a cooling step. As a non-limiting example of a cooling step, the temperature is reduced to below 100° C. at a cooling rate of about −5° C./min. The resulting cermets of the disclosed method comprise both coarse and fine $TiB_2$ phases, a $M_2B$ phase, a Ti(C,N) phase, a $M_xSi_y$ phase and a metal binder phase.

Another aspect of the present disclosure relates to an advantageous infiltration method of making the clad component with a bimodal boride cermet composition having lower melting point metal binders for use in erosion resistant applications at temperatures up to 1000° C. The infiltration method includes the following steps: i) making hard particle cloth by mixing a $TiB_2$ phase with a bimodal distribution of particles in the size range of 3 to 60 microns and 61 to 800 microns and other metals with organic binders, ii) making brazing cloth by mixing a lower melting point metal binder phase represented by the formula (DEF), wherein D is the base metal chosen from Fe, Ni, Co, Mn and mixtures thereof, E is the alloying metal comprising Cr, Si, and B, and F is the alloying element chosen from C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag and Au, with organic binders, iii) rolling both hard particle cloth and brazing cloth to a predetermined thickness and density and forming a flexible cloth that maintains a uniform weight and readily conforms to complex geometries, iv) cutting the cloth to the size of a metal surface to be protected from erosion at temperatures up to 1000° C., v) making a clad component by applying hard particle cloth to the metal surface and brazing cloth to hard particle cloth with a low temperature adhesive, vi) heating the clad component in a furnace at temperatures above the melting point of the brazing cloth and below the melting point of the metal surface in a controlled inert environment to effectuate infiltration of the molten brazing cloth down into the layer of hard particle cloth and metallurgical bonding the hard particle cloth to the metal surface, vii) cooling the heated component to form a clad component with a bimodal boride cermet composition having lower melting point metal binders.

In order to make hard particle cloth and brazing cloth, organic binders may be utilized. The organic binders may include binders, plasticizers, and surfactants. The organic binder is based on a thermoplastic material, such as a wax, or alternatively food-grade polymers, polyacetal, cellulose, gels, silanes, water, and various inorganic substances may be used. The wax may be a synthetic wax, and/or a natural wax. Non-limiting exemplary synthetic waxes are chosen from polyolefin waxes (polyethylene, polypropylene, polybutene-1, copolymers thereof, and terpolymers thereof), polytetrafluroethylene waxes, ethylene acrylic acid waxes, Fischer-Tropsch waxes and combinations thereof. Non-limiting exemplary natural waxes are chosen from paraffin waxes, Carnauba waxes, Montan waxes and combinations thereof. In addition, a combination of one or more synthetic waxes and one or more natural waxes may be included in the binder system.

Figure 4:
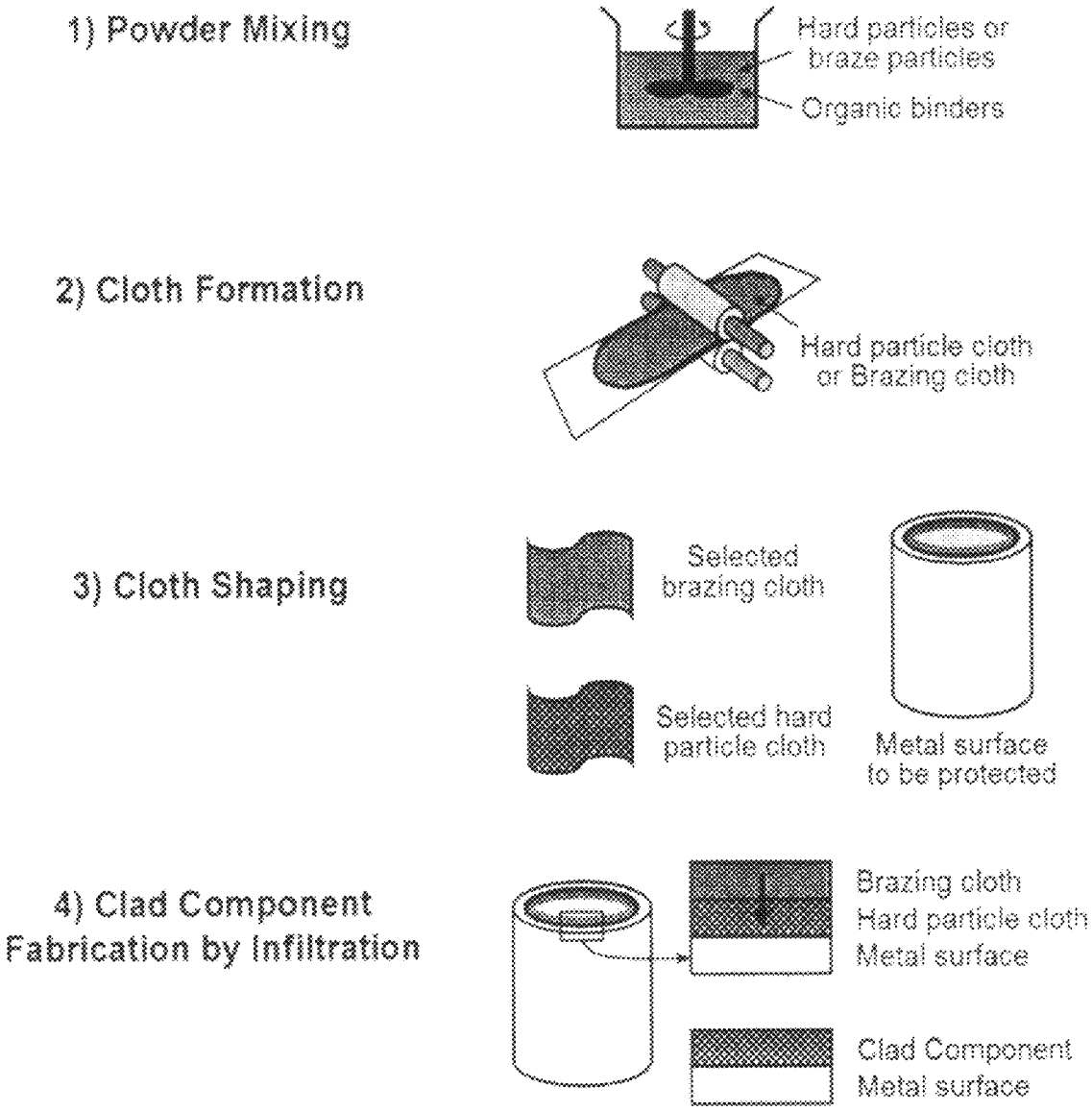
FIG. 4 depicts the steps of the infiltration process for making the clad component.

In one form, the binder system includes two or three components. A non-limiting exemplary binder, which is molten at 150° C., includes 65 vol % paraffin wax, 30 vol % polypropylene, and 5 vol % stearic acid. Cloth formation can be done by a rolling method but other formation methods may be utilized. A non-limiting list of alternative cloth formation methods includes extrusion, slip casting and doctor-blade tape casting. The alternative cloth formation methods provide a predetermined thickness and density of the cloth. Both hard particle cloth and brazing cloth can be shaped into a complex geometry, which can not be fabricated by a conventional powder metallurgy method. In particular, complex shapes having a high aspect ratio such as tubular products to be used as thermowells, cylindrical products and nozzles can be fabricated. As a non-limiting example, a hard metal cloth is shaped in a cylindrical form and inserted into the inside surface of a cylindrical metal surface that has to be protected in high temperature erosion applications. The interface between the metal surface and the hard particle cloth can be glued with low-temperature adhesive. Similarly a brazing cloth is shaped in a slightly smaller cylindrical form, inserted and glued into the inside surface of a hard metal cloth. The complete layered stack is placed in a brazing furnace and heated above the melting point of the brazing cloth and below the melting point of the metal surface. The molten blazing alloy wicks down into the layer of hard particles by a capillary force, metallurgically bonding the hard particles to the metal surface and forming the clad component. This process is schematically illustrated in FIG. 4.

Infiltration is a liquid state method of cermet fabrication, in which a preformed dispersed ceramic phase is soaked in a molten metal binder, which fills the space between the dispersed ceramic phase inclusions and solidifies upon cooling to ambient temperature. In order to provide excellent erosion resistance, fracture toughness and other mechanical properties of the cermets, good interfacial bonding (wetting) between the dispersed ceramic phase and the liquid metal binder should be obtained. The driving force of an infiltration process may be either capillary force of the dispersed ceramic phase (spontaneous infiltration) or an external pressure (for example, gaseous, mechanical, electromagnetic, centrifugal or ultrasonic) applied to the liquid metal phase (forced infiltration). As a non-limiting example, gas pressure infiltration, squeeze casting infiltration and pressure die infiltration may be utilized under the forced infiltration category.

Gas pressure infiltration utilizes a pressurized gas for applying pressure on the molten metal and forcing it to penetrate into a preformed dispersed ceramic phase. Gas pressure infiltration method may be used for manufacturing large parts or components with a bimodal cermet composition having lower melting point metal binders. This method allows short contact time of the bimodal boride ceramics with the molten metal binder and results in low damage of the bimodal boride ceramics.

Squeeze casting infiltration uses a movable mold part (ram) for applying pressure on the molten metal binder and forcing it to penetrate into a preformed dispersed ceramic phase, placed into the lower fixed mold part. The squeeze casting infiltration method includes the following steps: 1) a preform of dispersed ceramic phase is placed into the lower fixed mold half; ii) a molten metal in a predetermined amount is poured into the lower mold half; iii) the upper movable mold half (ram) moves downwards and forces the liquid metal to infiltrate the perform; iv) the infiltrated material solidifies under the pressure; and v) the part is removed from the mold by means of an ejector pin. The squeeze casting infiltration method may be used for manufacturing simple small parts.

Pressure die infiltration utilizes a die casting technology wherein a preformed dispersed ceramic phase is placed into a die (mold) which is then filled with a molten metal binder entering the die and penetrating into the preform under the pressure of a movable piston (plunger).

Uses and Applications

The bimodal cermet compositions having lower melting point metal binders of the present disclosure are particularly suitable in high temperature erosion/corrosion applications where refractories are currently employed. For example, refinery process vessel walls and internals that are exposed to streams of aggressive catalyst particles in various chemical and petroleum environments are particularly suitable for the bimodal cermet compositions. A non-limiting list of suitable uses includes liners for process vessels, transfer lines and process piping, heat exchangers, cyclones, for example, fluid-solids separation cyclones as in the cyclone of Fluid Catalytic Cracking Unit used in refining industry, grid hole inserts, thermo wells, valve bodies, slide valve gates and guides, and the like. Thus, metal surfaces exposed to erosive or corrosive environments at elevated temperature ranging from 300° C. to 850° C. are protected by providing the surface with a layer of the disclosed bimodal cermet compositions.

The disclosed bimodal cermet compositions having lower melting point metal binders can be formed into tiles. The tiles can then be affixed to inner metal surfaces of refinery and chemical process equipment by mechanical means or by welding to improve erosion and corrosion resistance at elevated temperatures. The disclosed bimodal cermet compositions having lower melting point metal binders can also be readily formed into a clad component by infiltration method. The clad component can be installed directly as a part in refinery and chemical process equipment to improve erosion and corrosion resistance at elevated temperatures.

The following example illustrates the present disclosure and the advantages thereto without limiting the scope thereof.

EXAMPLES

Illustrative Example 1

Bimodal $TiB_2$ Cermet Composition with H. C. Starek's $TiB_2$ Grit and a Low Melting Metal Binder (Alloy 1)

As a non-limiting example, 50 vol % coarse $TiB_2$ grit (S2ELG) and 50 vol % of fine $TiB_2$ grit (S) were mixed in a ball mill in the presence of heptane for a time sufficient to substantially disperse the powders in each other. The $TiB_2$ powder has a bimodal distribution of particles in the size range 3 to 60 microns and 61 to 800 microns. The mixture of powders was milled in a ball mill for about 4 hours. Paraffin wax was also added to the ball mill to provide green strength to the compact. The amount of paraffin wax added was about 2 to 4 wt % of the combined weight of both $TiB_2$ grit and stainless steel binder. After milling process, the liquid was removed and the milled powder was dried. The amount of milling media in the ball milling process was less than 40% of the powder added. Yttria stabilized zirconia (YSZ) balls was the milling media utilized. About 100 grams of bimodal $TiB_2$ powder mix was then placed in an alumina crucible and compacted at the bottom of the crucible. On top of the compacted $TiB_2$, about 100 grams of a low melting metal binder (Alloy 1, 64Fe:2ONi:6Cr:6Si:4B) was placed and compacted. The resulting two-layered compact in an alumina crucible was then placed into a furnace for infiltration.

Within the furnace, the green bodies were ramped up to 600° C. at heating rate of 3° C./min and held for 30 minutes. The process was run in cyclic argon and vacuum environments to burn out the paraffin wax binder. The binder burnt out bodies were further ramped up to 1250° C. at a heating rate of 5° C./min, and then held for 30 minutes in an argon environment. The temperature was then reduced to below 100° C. at a cooling rate of −5° C./min. The infiltrated cermet part prepared according to the process of the disclosure was then examined by scanning electron microscopy (SEM) after preparation of a metallographic specimen.

Figure 5:
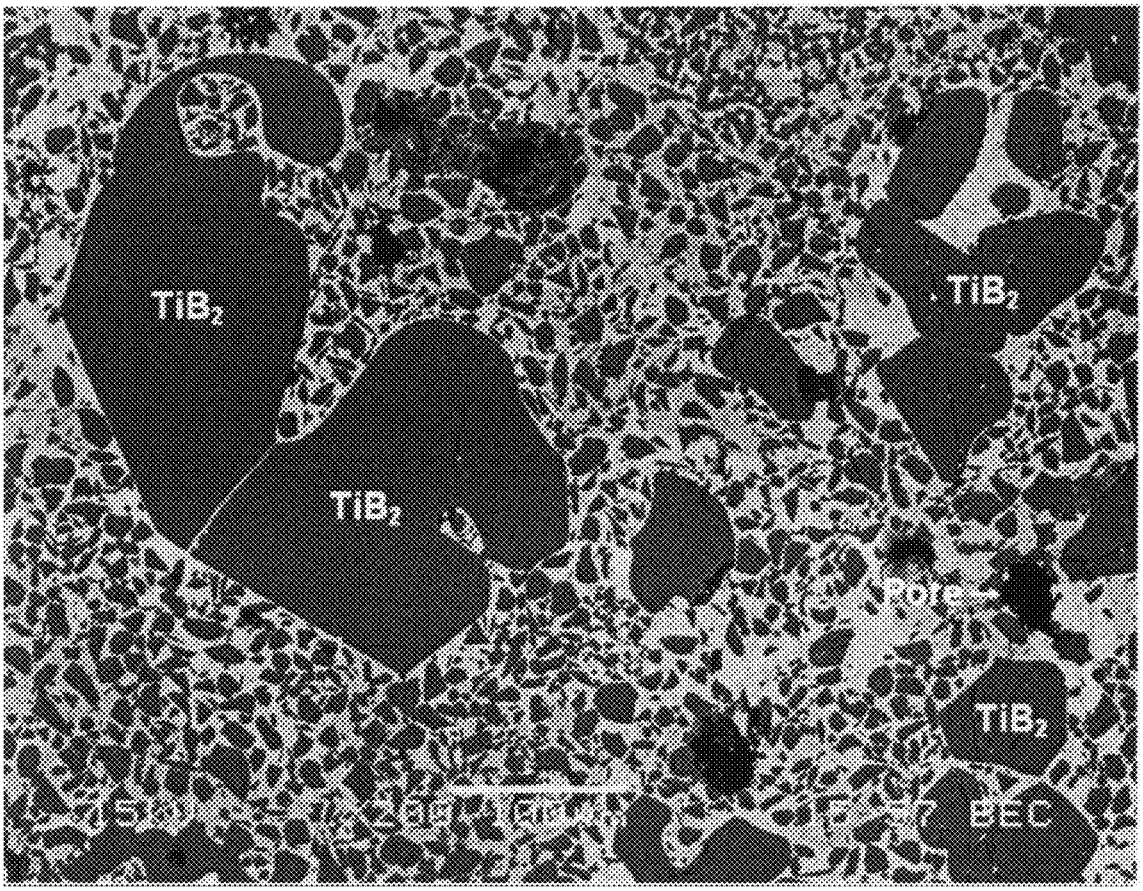
FIG. 5 depicts a representative scanning electron microscopy (SEM) image of the bimodal boride cermet having a 64Fe:2ONi:6Cr:6Si:4B metal binder phase.

FIG. 5 is a SEM image of a selected area of the bimodal $TiB_2$ cermet having a 64Fe:2ONi:6Cr:6Si:4B metal binder phase produced according to this example, wherein the scale bar represents 100 mm. Excluding pores the resulting bimodal $TiB_2$ cermet comprises both coarse and fine $TiB_2$ phases, a $M_2B$ phase, a Ti(C,N) phase, a $M_xSi_y$ phase and a metal binder phase. In this image both a portion of coarse $TiB_2$ grit and fine $TiB_2$ grits appear dark; the metal binder phase appears bright; and the other phases (a $M_2B$ phase, a Ti(C,N) phase and a $M_x$,$Si_y$ phase) appear also bright in various degrees. Based on Energy Dispersive X-ray Analysis (EDXS) in SEM, the resultant bimodal boride cermet having a lower melting point metal binder included:

i) 67 vol % $TiB_2$ with a bimodal grit distribution of both coarse and fine grits.

ii) 1 vol % secondary boride $M_2B$ where M=47Cr:51Fe:2Ti in wt %.

iii) 1 vol % Ti(C,N) phase.

iv) 5 vol % metal silicide $M_xSi_y$ where M=Bal.Fe:47.9Ni:15.4Si:1.4Ti:0.6Cr in wt %.

v) 26 vol % Cr-depleted alloy binder (Bal.Fe:5.9Ni:8.5Cr:1.3Ti:0.3Si in wt %).

Illustrative Example 2:

Bimodal $TiB_2$ Cermet Composition with H. C. Starck's $TiB_2$ Grit and a Low Melting Metal Binder (Alloy 2)

Utilizing the process described in Illustrative Example 1, an infiltrated cermet part was prepared by use of a low melting metal binder (Alloy 2, 57Fe:20Ni:18Cr:5B) and examined by SEM after preparation of a metallographic specimen.

Figure 6:
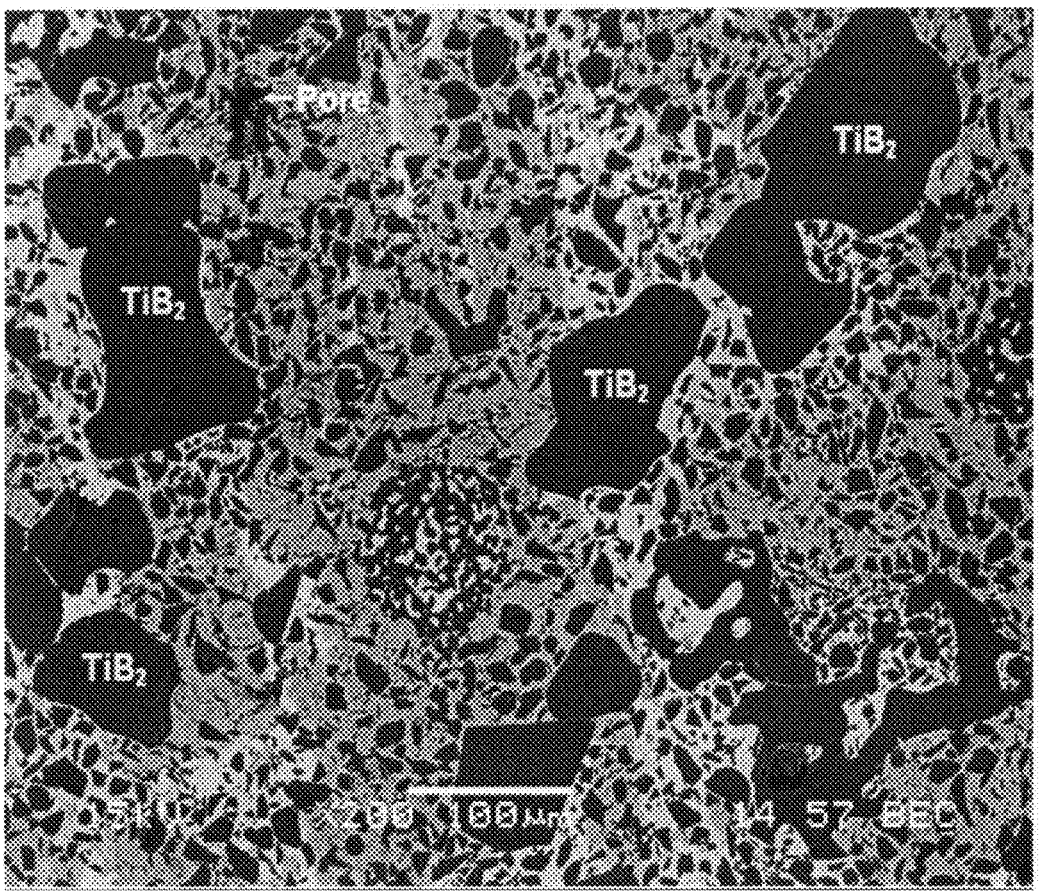
FIG. 6 depicts a representative scanning electron microscopy (SEM) image of the bimodal boride cermet having a 57Fe:2ONi:18Cr:5B metal binder phase.

FIG. 6 is a SEM image of a selected area of the bimodal $TiB_2$ cermet having a 57Fe:2ONi:18Cr:5B metal binder phase produced according to this example, wherein the scale bar represents 100 mm. Excluding pores the resulting bimodal $TiB_2$ cermet comprises both coarse and fine $TiB_2$ phases, a $M_2B$ phase, a Ti(C,N) phase, and a metal binder phase. In this image both a portion of coarse $TiB_2$ grit and fine $TiB_2$ grits appear dark; the metal binder phase appears bright; and the other phases (a $M_2B$ phase and a Ti(C,N) phase) appear also bright in various degrees. Based on EDXS in SEM, the resultant bimodal boride cermet having lower melting point metal binders included:

i) 67 vol % $TiB_2$ with a bimodal grit distribution of both coarse and fine grits.

ii) 2 vol % secondary boride $M_2B$ where M=5OCr:48Fe:2Ti in wt %.

iii) 1 vol % Ti(C,N) phase.

iv) 30 vol % Cr-depleted alloy binder having two compositions: a) 22 vol % of alloy binder having a composition, Bal.Fe:10.3Ni:15.OCr:1.7Ti in wt %, and b) 8 vol % of alloy binder having a composition, Bal.Fe:42.3Ni:5.5Cr:1.7Ti in wt %.

Illustrative Example 3

Bimodal $TiB_2$ Cermet Composition with H. C. Starck's $TiB_2$ Grit and a Low Melting Metal Binder (Alloy 4)

Utilizing the process described in Illustrative Example 1, an infiltrated cermet part was prepared by use of a low melting metal binder (Alloy 4, 5lFe:2ONi:18Cr:6Si:5B) and examined by SEM after preparation of a metallographic specimen.

Figure 7:
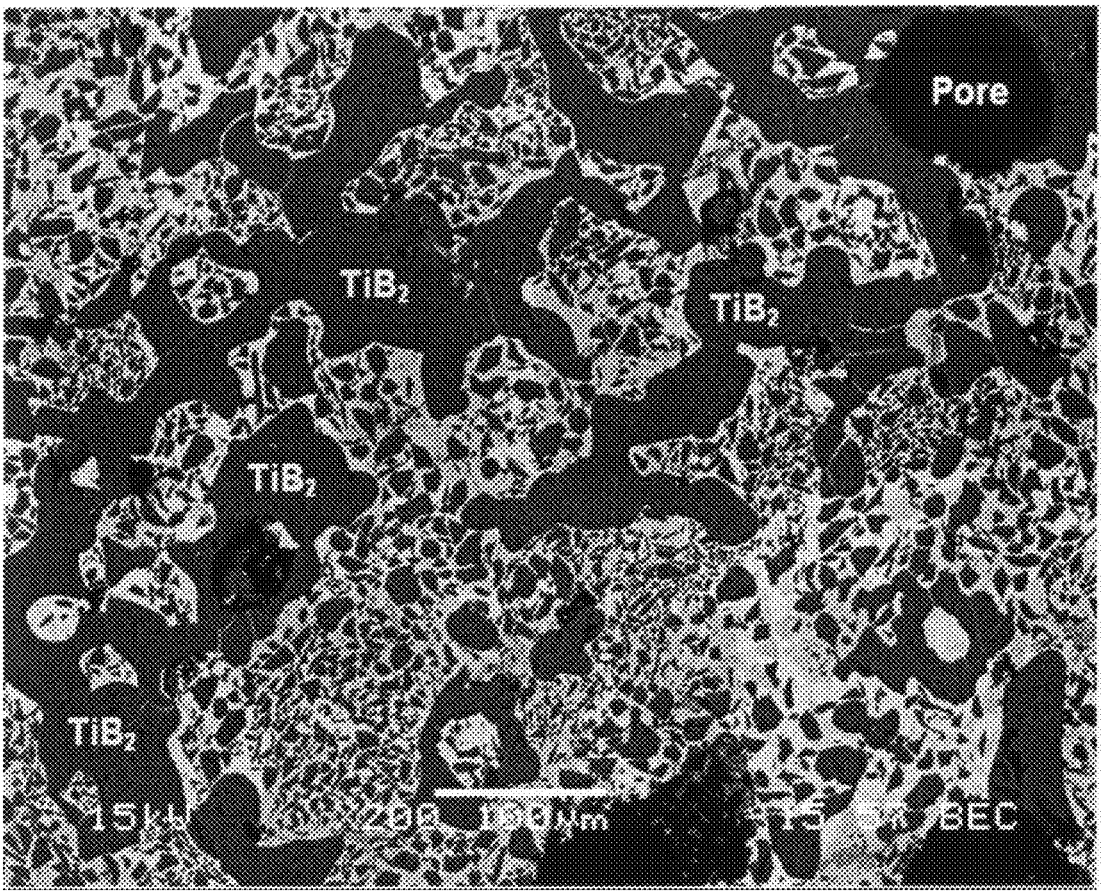
FIG. 7 depicts a representative scanning electron microscopy (SEM) image of the bimodal boride cermet having a 51Fe:2ONi:18Cr:6Si:5B metal binder phase.

FIG. 7 is a SEM image of a selected area of the bimodal $TiB_2$ cermet having a 64Fe:2ONi:6Cr:6Si:4B metal binder phase produced according to this example, wherein the scale bar represents 100 mm. Excluding pores the resulting bimodal $TiB_2$ cermet comprises both coarse and fine $TiB_2$ phases, a $M_2B$ phase, a Ti(C,N) phase, a $M_xSi_y$ phase and a metal binder phase. In this image both a portion of coarse $TiB_2$ grit and fine $TiB_2$ grits appear black; the metal binder phase appears white; and the other phases (a $M_2B$ phase, a Ti(C,N) phase and a $M_xSi_y$ phase) appear gray in various degrees. Based on EDXS in SEM, the resultant bimodal boride cermet having lower melting point metal binders includeed:

i) 67 vol % $TiB_2$ with a bimodal grit distribution of both coarse and fine grits.

ii) 1 vol % secondary boride $M_2B$ where M=49Cr:49Fe:2Ti in wt %.

iii) 1 vol % Ti(C,N) phase.

iv) 5 vol % metal silicide $M_xSi_y$ where M=Bal.Fe:50.2Ni:16.6Si:1.7Ti:1.4Cr in wt %.

v) 26 vol % Cr-depleted alloy binder (Bal.Fe:5.8Ni:17.6Cr:1.9Ti:0.4Si in wt %).

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A multimodal cermet composition comprising: a) a ceramic phase, and b) a low melting point metal binder phase, wherein said ceramic phase is a metal boride with a multimodal distribution of particles, wherein the metal of the metal boride is chosen from the group consisting of Group IV, Group V, Group VI elements of the Long Form of the Periodic Table of Elements, and mixtures thereof, and wherein said low melting metal binder phase is represented by the formula (DEF), wherein D is a base metal chosen from the group consisting of Fe, Ni, Co, Mn and mixtures thereof, E is an alloying metal comprising Cr, Si, and B, and F is an alloying element chosen from the group consisting of C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, wherein said alloying metal E includes from 0.5 to 8 wt% B based on the total weight of the lower melting point metal binder phase (DEF), and wherein said low melting metal binder phase has a melting point less than 1250° C.

2. The multimodal cermet composition of claim 1 wherein said low melting metal binder phase has a melting point less than 1150° C.

3. The multimodal cermet composition of claim 1 wherein said base metal D includes less than 45 wt% of Ni based on the total weight of the low melting point metal binder phase (DEF).

4. The multimodal cermet composition of claim 3 wherein said base metal D includes less than 35 wt% of Ni based on the total weight of the low melting point metal binder phase (DEF).

5. The multimodal cermet composition of claim 1 wherein said alloying metal E includes from 5 to 40 wt% Cr based on the total weight of the low melting point metal binder phase (DEF).

6. The multimodal cermet composition of claim 1 wherein said alloying metal E includes from 0.5 to 8 wt% Si based on the total weight of the lower melting point metal binder phase (DEF).

7. The multimodal cermet composition of claim 1 wherein said alloying element F includes less than 0.5 wt% of C based on the total weight of the low melting point metal binder phase (DEF).

8. The multimodal cermet composition of claim 7 wherein said alloying element F includes less than 0.1 wt% of C based on the total weight of the low melting point metal binder phase (DEF).

9. The multimodal cermet composition of claim 1 wherein said alloying element F includes from 0.1 to 3.0 wt% Ti based on the total weight of the low melting point metal binder phase (DEF).

10. The multimodal cermet composition of claim 1 wherein said ceramic phase comprises from 60 to 95 vol% of the volume of said multimodal cermet composition.

11. The multimodal cermet composition of claim 1 wherein said multimodal distribution of ceramic particles comprises fine grit particles in the size range of 3 to 60 microns and coarse grit particles in the size range of 61 to 800 microns.

12. The multimodal cermet composition of claim 1 wherein said multimodal distribution of ceramic particles comprises fine grit particles with an average particle size of 15 microns and coarse grit particles with an average particle size of 200 microns.

13. The multimodal cermet composition of claim 1 wherein said multimodal distribution of ceramic particles comprises 50 vol% of said fine grit particles and 50 vol% of said coarse grit particles.

14. The multimodal cermet composition of claim 1 further comprising at least one secondary metal boride, $M_xB_y$, wherein the molar ratio of x:y is in the range of 3:1 to 1:6.

15. The multimodal cermet composition of claim 13 wherein M of said at least one secondary metal boride, $M_xB_y$, is chosen from the group consisting of Group IV, Group V, Group VI elements of the Long Form of the Periodic Table of Elements, Fe, Ni, Co, Mn and mixtures thereof.

16. The multimodal cermet composition of claim 1 further comprising an impurity phase chosen from the group consisting of a metal oxide, a metal carbide, a metal nitride, a metal carbonitride and combinations thereof, wherein said metal is chosen from the group consisting of Fe, Ni, Co, Mn, Al, Cr, Y, Si, Ti, Zr, Hf, V, Nb, Ta, Mo, W and mixtures thereof.

17. The multimodal cermet composition of claim 16 wherein said impurity phase comprises less than 5 vol% of the volume of said multimodal cermet composition.

18. The multimodal cermet composition of claim 17 wherein said impurity phase comprises less than 2 vol% of the volume of said multimodal cermet composition.

19. The multimodal cermet composition of claim 1 further comprising at least one metal silicide, $M_xSi_y$, wherein the molar ratio of x:y is in the range of 4:1 to 1:2.

20. The multimodal cermet composition of claim 19 wherein M of said at least one metal $M_xSi_y$, is chosen from the group consisting of Group IV, Group V, Group VI elements of the Long Form of the Periodic Table of Elements, Fe, Ni, Co, Mn and mixtures thereof.

21. The multimodal cermet composition of claim 20 wherein said metal silicide, $M_xSi_y$, comprises less than 15 vol% of the volume of said multimodal cermet composition.

22. The multimodal cermet composition of claim 21 wherein said metal silicide, $M_xSi_y$, comprises less than 5 vol% of the volume of said multimodal cermet composition.

23. The multimodal cermet composition of claim 1 wherein the porosity is up to 10 vol% of the volume of said multimodal cermet composition.

24. A bimodal cermet composition comprising:

a) a $TiB_2$ phase with a bimodal distribution of particles in the size range of 3 to 60 microns and 61 to 800 microns;

b) a $M_2B$ phase wherein M is chosen from the group consisting of Cr, Fe, Ni, Ti and combinations thereof;

c) an impurity phase chosen from the group consisting of $TiO_2$, TiC, TiN, Ti(C,N), and combinations thereof;

d) a $M_xSi_y$ phase wherein M is chosen from the group consisting of Fe, Ni, Cr, Ti and combinations thereof; and e) a low melting point metal binder phase represented by the formula (DEF), wherein D is a base metal chosen from the group consisting of Fe, Ni, Co, Mn and mixtures thereof, E is an alloying metal comprising Cr, Si, and B, and F is an alloying element chosen from the group consisting of C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, wherein said alloying metal E includes from 0.5 to 8 wt% B based on the total weight of the lower melting point metal binder phase (DEF), and wherein said low melting metal binder phase has a melting point less than 1250° C.

25. The bimodal cermet composition of claim 24 wherein said low melting metal binder phase has a melting point less than 1150° C.

26. The bimodal cermet composition of claim 24 wherein said base metal D includes less than 45 wt% of Ni based on the total weight of the low melting point metal binder phase (DEF).

27. The bimodal cermet composition of claim 24 wherein said alloying metal E includes from 5 to 40 wt% Cr based on the total weight of the low melting point metal binder phase (DEF).

28. The bimodal cermet composition of claim 24 wherein said alloying metal E includes from 0.5 to 8 wt% Si based on the total weight of the lower melting point metal binder phase (DEF).

29. The bimodal cermet composition of claim 24 wherein said alloying element F includes less than 0.5 wt% of C based on the total weight of the low melting point metal binder phase (DEF).

30. The bimodal cermet composition of claim 24 wherein said alloying element F includes from 0.1 to 3.0 wt% Ti based on the total weight of the low melting point metal binder phase (DEF).

31. The bimodal cermet composition of claim 24 wherein said $TiB_2$ phase comprises from 60 to 95 vol% of the volume of said bimodal cermet composition.

32. The bimodal cermet composition of claim 24 wherein said bimodal distribution of particles comprises 50 vol% of said fine grit particles and 50 vol% of said coarse grit particles.

33. The bimodal cermet composition of claim 24 wherein said impurity phase comprises less than 5 vol% of the volume of said bimodal cermet composition.

34. The bimodal cermet composition of claim 24 wherein said $M_xSi_y$ phase comprises less than 15 vol% of the volume of said bimodal cermet composition.

35. The bimodal cermet composition of claim 24 wherein the porosity is up to 10 vol% of the volume of said bimodal cermet composition.

36. A method for protecting a metal surface subject to erosion at temperatures up to 1000° C., the method comprising providing a metal surface with a multimodal cermet composition, wherein said composition comprises: a) a ceramic phase, and b) a low melting point metal binder phase, wherein said ceramic phase is a metal boride with a multimodal distribution of particles, wherein the metal of the metal boride is chosen from the group consisting of Group IV, Group V, Group VI elements of the Long Form of the Periodic Table of Elements, and mixtures thereof, and wherein said low melting metal binder phase is represented by the formula (DEF), wherein D is a base metal chosen from the group consisting of Fe, Ni, Co, Mn and mixtures thereof, E is an alloying metal comprising Cr, Si, and B, and F is an alloying element chosen from the group consisting of C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, wherein said alloying metal E includes from 0.5 to 8 wt% B based on the total weight of the lower melting point metal binder phase (DEF), and wherein said low melting metal binder phase has a melting point less than 1250° C.

37. The method of claim 36 wherein said ceramic phase comprises from 60 to 95 vol% of the volume of said multimodal cermet composition.

38. The method of claim 36 wherein said multimodal distribution of ceramic particles comprises fine grit particles in the size range of 3 to 60 microns and coarse grit particles in the size range of 61 to 800 microns.

39. The method of claim 36 further comprising at least one secondary metal boride, $M_xB_y$, wherein the molar ratio of x:y varies in the range of about 3:1 to about 1:6, and wherein M of said at least one secondary metal boride, $M_xB_y$, chosen from the group consisting of Group IV, Group V, Group VI elements of the Long Form of the Periodic Table of Elements, Fe, Ni, Co, Mn, Cr, Al, Y Si, and mixtures thereof.

40. The method of claim 36 further comprising an impurity phase chosen from the group consisting of a metal oxide, a metal carbide, a metal nitride, a metal carbonitride and combinations thereof, wherein said metal is chosen from the group consisting of Fe, Ni, Co, Mn, Al, Cr, Y, Si, Ti, Zr, Hf, V, Nb, Ta, Mo and W and mixtures thereof, and wherein said impurity phase constitutes less than about 5 vol% of the volume of said multimodal cermet composition.

41. The method of claim 36 wherein said multimodal cermet composition is formed by a powder metallurgy process or an infiltration process.

42. The method of claim 41 wherein the infiltration process is spontaneous infiltration or forced infiltration, wherein said forced infiltration is chosen from the group consisting of gas pressure infiltration, squeeze casting infiltration and pressure die infiltration.

43. The method of claim 36 wherein the metal surface is the inner surface of refinery and chemical process equipment.

44. The method of claim 43 wherein said refinery and chemical process equipment is chosen from the group consisting of process vessels, transfer lines and process piping, heat exchangers, cyclones, grid inserts, thermo wells, valve bodies, and slide valve gates and guides.

45. A method for protecting a metal surface subject to erosion at temperatures up to 1000° C., the method comprising providing a metal surface with a bimodal boride cermet composition, wherein said composition comprises:

a) a $TiB_2$ phase with a bimodal distribution of particles in the size range of 3 to 60 microns and 61 to 800 microns;

b) a $M_2B$ phase wherein M is chosen from the group consisting of Cr, Fe, Ni, Ti and combinations thereof c) an impurity phase chosen from the group consisting of $TiO_2$, TiC, TiN, Ti(C,N), and combinations thereof;

d) a $M_xSi_y$ phase wherein M is chosen from the group consisting of Fe, Ni, Cr, Ti and combinations thereof; and e) a low melting point metal binder phase represented by the formula (DEF), wherein D is a base metal chosen from the group consisting of Fe, Ni, Co, Mn and mixtures thereof, E is an alloying metal comprising Cr, Si, and B, and F is an alloying element chosen from the group consisting of C, N, P, Al, Ga, Ge, As, In, Sn, Sb, Pb, Sc, La, Y, Ce, Ti, Zr, Hf, V, Nb, Ta, Mo, W, Re, Ru, Rh, Ir, Pd, Pt, Cu, Ag, Au and mixtures thereof, wherein said alloying metal E includes from 0.5 to 8 wt% B based on the total weight of the lower melting point metal binder phase (DEF), and wherein said low melting metal hinder phase has a melting point less than 1250° C.

46. The bimodal cermet composition of claim 45 wherein said $TiB_2$ phase comprises from 60 to 95 vol% of the volume of said bimodal cermet composition.

47. The bimodal cermet composition of claim 45 wherein said impurity phase comprises less than 5 vol% of the volume of said bimodal cermet composition.

48. The bimodal cermet composition of claim 45 wherein said $M_xSi_y$ phase comprises less than 15 vol% of the volume of said bimodal cermet composition.

49. The method of claim 45 wherein said bimodal cermet composition is formed by a powder metallurgy process or an infiltration process.

50. The method of claim 49 wherein the infiltration process is spontaneous infiltration or forced infiltration, wherein said forced infiltration is chosen from the group consisting of gas pressure infiltration, squeeze casting infiltration and pressure die infiltration.

51. The method of claim 45 wherein the metal surface is the inner surface of refinery and chemical process equipment.

52. The method of claim 51 wherein said refinery and chemical process equipment is chosen from the group consisting of process vessels, transfer lines and process piping, heat exchangers, cyclones, grid inserts, thermo wells, valve bodies, and slide valve gates and guides.

* * * * *